US006170392B1

(12) United States Patent
Watercutter et al.

(10) Patent No.: US 6,170,392 B1
(45) Date of Patent: Jan. 9, 2001

(54) UPPER SLIDE DRIVE ROD AND SPACER DESIGN

(75) Inventors: Brian A. Watercutter, Minster; Bradley A. Burns, Wapakoneta, both of OH (US)

(73) Assignee: The Minster Machine Company, Minster, OH (US)

( * ) Notice: Under 35 U.S.C. 154(b), the term of this patent shall be extended for 0 days.

(21) Appl. No.: 09/195,396

(22) Filed: Nov. 18, 1998

(51) Int. Cl.[7] ..... B30B 7/04; B30B 1/28

(52) U.S. Cl. ..... 100/264; 72/407; 72/452.5; 74/593; 100/282

(58) Field of Search ..... 100/257, 264, 100/282; 72/407, 452.5; 74/593

(56) References Cited

U.S. PATENT DOCUMENTS

| | | | | |
|---|---|---|---|---|
| 1,294,959 | * | 2/1919 | Seymour | 74/593 |
| 1,781,032 | | 11/1930 | Redfield . | |
| 2,495,084 | * | 1/1950 | Wells | 100/282 |
| 2,532,320 | * | 12/1950 | Maussnest | 100/282 |
| 2,700,333 | * | 1/1955 | Polsen et al. | 100/282 |
| 2,766,710 | * | 10/1956 | Brandes | 72/407 |
| 3,249,041 | | 5/1966 | Johnson . | |
| 3,281,170 | | 10/1966 | Kaplan . | |
| 3,407,685 | | 10/1968 | Prince . | |
| 4,307,599 | | 12/1981 | Wrona . | |
| 4,318,295 | * | 3/1982 | Sindelar | 100/282 |
| 4,386,516 | * | 6/1983 | Wunsch et al. | 100/282 |
| 4,819,555 | | 4/1989 | Ballantyne et al. . | |
| 4,890,476 | * | 1/1990 | Takahashi et al. | 100/282 |
| 4,923,386 | * | 5/1990 | Eshima et al. | 100/282 |
| 4,947,673 | | 8/1990 | Baranski . | |
| 5,852,970 | * | 12/1998 | Bornhorst et al. | 100/282 |

* cited by examiner

*Primary Examiner*—Stephen F. Gerrity
(74) *Attorney, Agent, or Firm*—Randall J. Knuth

(57) ABSTRACT

A drive rod composed of segments joined together to form a single length for use in a mechanical press. The individual drive rod segments may be separated for ease of assembly into the mechanical press or for servicing the mechanical press. In addition, a split locating collar is used for removably attaching the drive rod to the upper slide of a mechanical press. Drive rod length and slide shutheight may be changed by utilizing spacer elements.

15 Claims, 5 Drawing Sheets

UPPER SLIDE DRIVE ROD AND SPACER DESIGN

BACKGROUND OF THE INVENTION

1. Field of the Invention

The present invention relates to a mechanical press and, in particular, a drive rod that is split at one or more places along its length and coupled together to form a rigid drive rod for motivating a slide or bed.

2. Description of the Related Art

Mechanical presses, for example, stamping presses and drawing presses, include a frame having a crown and a bed and a slide supported within the frame for motion toward and away from the bed. Such presses are widely used for stamping and drawing operations and vary substantially in size and available tonnage depending upon the attended use.

In the container art, the press workpiece or cup is usually formed of steel strip coated with a particular plastic layer. Various types of plastic are utilized to coat the steel. By carefully drawing and stamping the steel strip, containers with an interior plastic coating are created. These plastic liners are attached to the steel so that product contained within the formed can, e.g., liquid, does not touch the steel or metal.

In double action presses, a second slide replaces the bed and reciprocates in opposed relationship to the first slide. Traditional double action presses have slides driven by a plurality of crankshafts having various connecting arrangements connected to the slides. Typically, mechanical presses are fully assembled within the manufacturer's factory. For shipping purposes, the press is subsequently partially disassembled or "un-stacked." Normally, un-stacking entails removing the crown, upper slide, and drive rod from the base and crankshaft.

One form of current mechanical presses contains a continuous drive rod shaft attached between a crankshaft and an upper slide. The drive rod transfers rotational motion from the crankshaft to reciprocal motion which drives an upper slide upward and downward. To insure necessary tolerances and provide adequate strength, traditional drive rods are formed as a continuous drive rod shaft. Drive rod guide housings are installed around the upper and lower portions of the drive rod to assist in guiding the drive rod.

One problem with the continuous drive rod shaft design is that assembly and disassembly of the drive rod from a mechanical press requires the entire shaft to be handled. For example, when assembling a traditional press, the entire drive rod must be inserting through both the upper and lower guide housings at the same time. A continuous drive rod shaft is heavy and cumbersome making maneuvering of the drive rod difficult. Consequently, assembling and servicing of the press is complicated as a result of having to handle the entire shaft.

Yet another problem with current continuous drive rod shaft design is that the upper and lower guide housings are required to be perfectly in line with one another. Consequently, assembly of the press demands accurate alignment of the upper and lower guide housings.

Another problem with the current design is that replacement of a drive rod guide housing requires the entire drive rod to be removed. Removing the entire drive rod is further complicated by the fact that the upper slide or ram must be removed first. Therefore, if service or maintenance of the drive rod guide is required, both the entire drive rod and the upper slide must be removed. In addition, since current drive rods are composed of a single, continuous shaft, the entire drive rod shaft must be handled when removing the drive rod. Consequently, service or maintenance of the drive rod guide housing or the drive rod, itself, can be intricate and costly due to these limitations.

A further problem with the current continuous drive rod shaft design is that the entire drive rod must also be removed when the press is "un-stacked" for shipping purposes. Since the drive rod is a continuous shaft, the entire drive rod must be removed when "un-stacking" the press. As a result, there is an associated cost included within the cost of manufacturing, shipping, and reassembly of the mechanical press.

SUMMARY OF THE INVENTION

According to the present invention, a drive rod is divided into at least two segments which are coupled together to form a single length drive rod. A split, locating collar is provided for removing the drive rod from the press without removing the slide from the press.

The invention, in one form thereof, is a drive rod for a mechanical press. The drive rod includes at least a first and a second drive rod segment. Coupling means are used for joining the first drive segment to the second drive segment. In a further embodiment, the first and second drive segments include a coupling end. A first and a second flange are located on the coupling end of the first drive rod segment and the second drive rod segment, respectively. Clamping means are used for clamping the first flange to the second flange.

The invention in another form thereof, is a mechanical press with a drive rod. The drive rod has two ends and is composed of at least a first and a second drive rod segment. Coupling means joins the first drive rod segment to the second drive rod segment. A crankshaft is connected to one end of the drive rod. A drive mechanism rotates the crankshaft. In a further embodiment, the mechanical press includes a first slide and slide attachment means for removably attaching the other end of the drive rod to the first slide. In yet a further embodiment, the slide attachment means comprises the first slide with a drive rod aperture. The other end of the drive rod is disposed within the drive rod aperture. A split locating collar is annularly disposed along the drive rod below the slide. The split collar contains a plurality of split collar apertures and contains split collar fastening means for removably clamping the split collar to or about the drive rod. In some embodiments, the split collar is not required to be clamped onto the drive rod.

The invention, in another form thereof, is a mechanical press comprising a drive rod having two ends. A slide attachment means removably attaches a first slide to one end of the drive rod. A crankshaft is connected to the other end of the drive rod. A drive mechanism is used to rotate the crankshaft. In a further embodiment, a second slide is disposed in opposed relationship to the other slide. The first slide comprises an upper slide and the second slide comprises a lower slide.

The invention in yet another form thereof, is a mechanical press including an upper slide and a lower slide disposed in opposed relationship to each other. The upper slide contains a drive rod aperture. There is a drive rod having two ends composed of an upper drive rod segment and a lower drive rod segment. The upper and lower drive segments contain a coupling end. A first and a second flange are located on the coupling end of the first drive rod segment and the second drive rod segment, respectively. The first and second flange contain a plurality of flange apertures. A plurality of flange bolts are inserted through the first and second flange apertures for securing the first and second drive rod segments together. The other said end of the drive rod is disposed within the drive rod aperture. A split locating collar is annularly disposed along the drive rod below the slide. The split collar contains a plurality of split collar apertures and contains split collar fastening means for removably attaching the split collar about the drive rod. A split collar is disposed between the other end of the drive rod and the upper slide. The split collar contains a plurality of split collar apertures. A plurality of split collar bolts are disposed within the split collar aperture for removably connecting the split collar about the drive rod. A crankshaft is connected to the other end of the drive rod.

An advantage of the present invention is that the new drive rod can be assembled into a mechanical press more easily than conventional drive rods. Since the drive rod is split at one or more places along its length, only one segment or portion of the drive rod needs to be handled at a time. In addition, the split design allows the lower part of the drive rod to be assembled with the other main press components. The upper part of the drive rod can be installed after the press has been shipped to its final destination.

Another advantage of the present invention is the elimination of the need to have both the upper and lower guide housings installed together. The split drive rod permits the lower part of the drive rod to be assembled along with the lower guide housing. The upper drive rod can then be assembled at a later time.

An additional advantage is that the upper and lower guide housings no longer are required to be perfectly in line with one another. The guide housings can be offset with no effect to the drive. All that is required is that the individual drive rods are centered in their respective housing followed by the upper and lower drive rod flanges being bolted together.

An additional advantage of the present invention is that the guide housings can be replaced by removing the drive rod without removing the upper slide. The split locating collar along the drive rod below the upper slide allows for the separation of the drive rod from the slide. The drive rod can then be pulled up through the upper slide through a clearance hole in the slide which is larger than the drive rod diameter. Consequently, access is gained to the guide housings for their service, removal, or replacement.

A further advantage of the present invention is that the drive rod and upper slide do not need to be removed when un-stacking the press for shipping. Instead, the drive rod can be separated by unbolting the drive rod flanges that connect the drive rod segments together. Once the drive rod segments are separated from one another, the press can be un-stacked.

A yet further advantage of the present invention is that the split collar is designed to distribute the drive rod preload across the bottom surface of the upper slide. The distributed preload reduces the stress created in the slide by the preload. The reduced stress level permits the slide weight to be minimized allowing for improved bearing performance and/or faster running speeds.

A further advantage of the invention is that the slide shutheight can be easily set. Spacers are located between the joined drive rod segments. By grinding these spacers or including thicker spacers, the slide shutheight can be adjusted. In addition, slide shutheight can be adjusted by grinding down the split locating collar or replacing the split locating collar with a thicker one.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
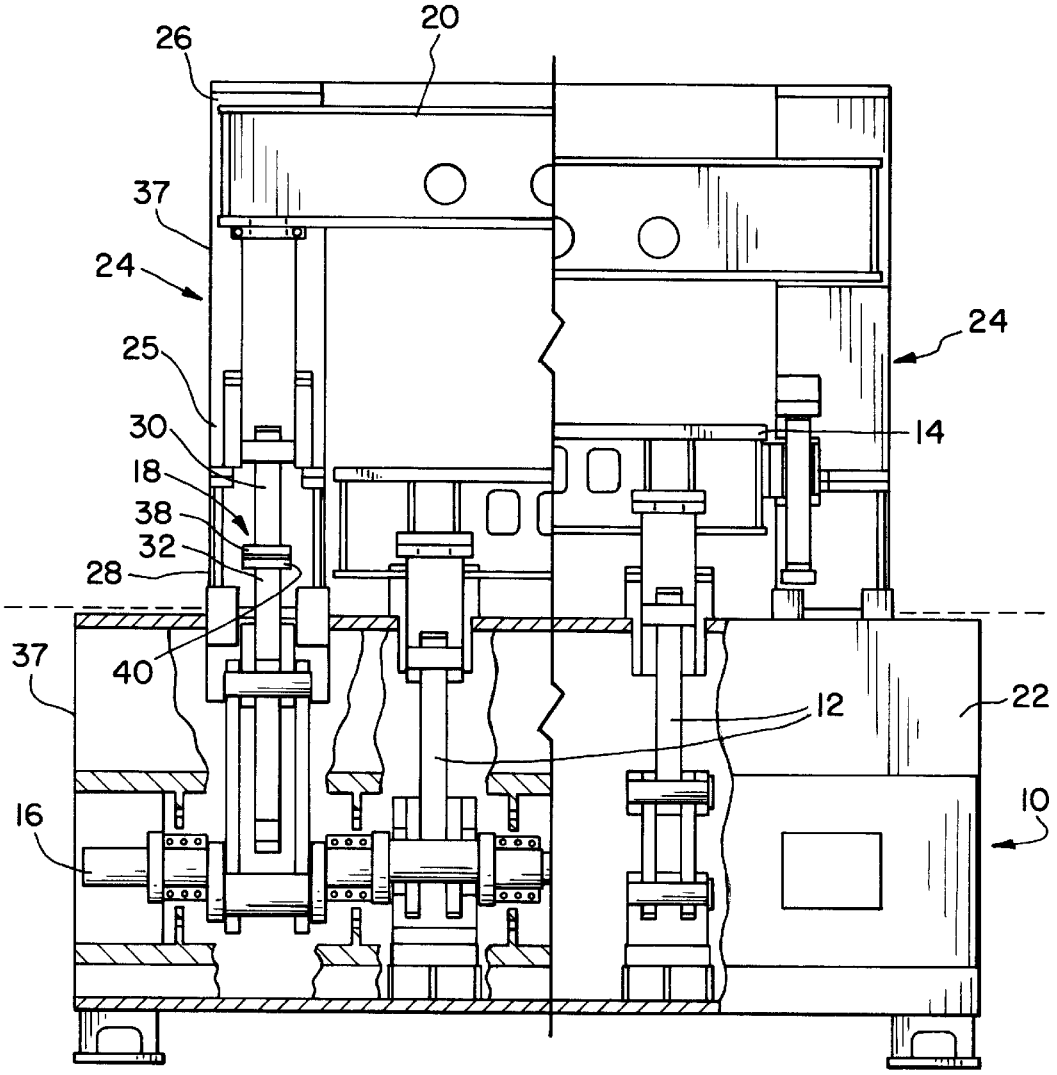
FIG. 1 is a front elevational cut-away view of a double slide press incorporating the present invention depicting the upper slide in the up position (left half) and in the down position (right half)
Figure 2:
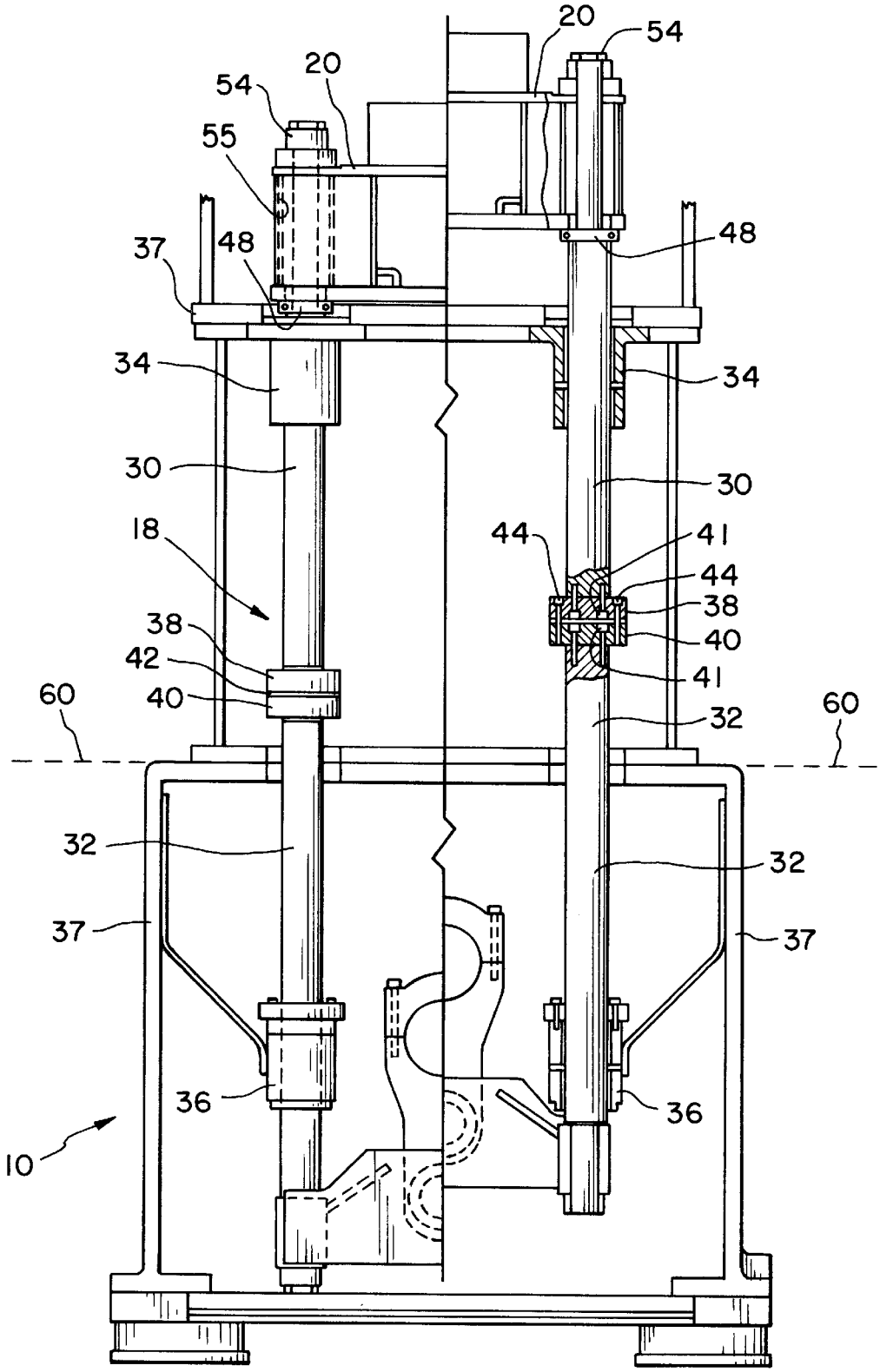
FIG. 2 is a front elevational cut-away view showing an upper and lower drive rod with split collar depicting the upper slide in the up position (left half) and in the down position (right half)

Referring now to the drawings and particularly to FIGS. 1 and 2, an underdrive double slide press 10 of the present invention is shown. Press 10 includes a lower linkage mechanism 12 for reciprocating lower slide 14. Lower linkage mechanism 12 is driven by crankshaft 16. Upper linkage mechanism 18 is also connected to crankshaft 16 to drive or reciprocate upper slide 20. Crankshaft 16 is located within a base 22 of press 10. Attached to base 22 are a pair of uprights 24. Uprights 24 are split into two sections, so there is an upper upright section 25 and a lower upright section 28. Crown 26 is connected to uprights 25. Lower slide 14 and upper slide 20 are oriented opposite each other and during press operation move toward and away from each other.

Upper linkage or drive rod 18 is divided into a plurality of drive rod segments. Drive rod 18 is depicted in FIGS. 1 and 2 as being divided into two segments, namely, upper drive rod 30 and lower drive rod 32. Although this invention is described as containing two drive rod segments for ease of description, upper drive rod 30 and lower drive rod 32, drive rod 18 may be divided into additional drive rod segments.

Upper drive rod housing guide 34 and lower drive rod housing guide 36 guide drive rod 18 during reciprocation of upper slide 20. Upper and lower drive rod housing guide 34, 36 are mounted to the stationary frame 37.

Figure 3:
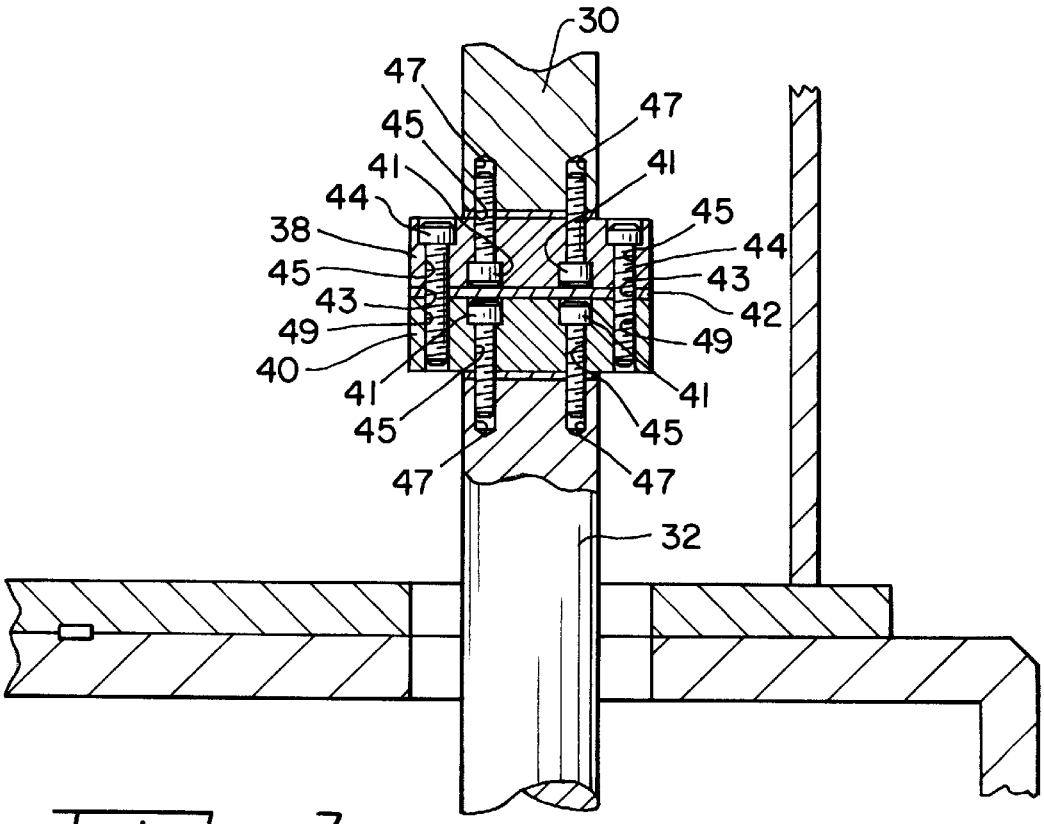
FIG. 3 shows an upper and lower drive rod.
Figure 5:
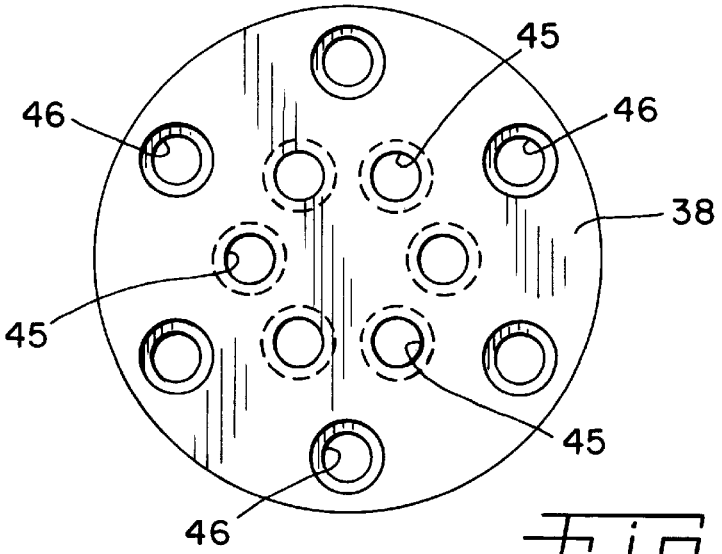
FIG. 5 is a top view of upper drive rod flange.
Figure 6:
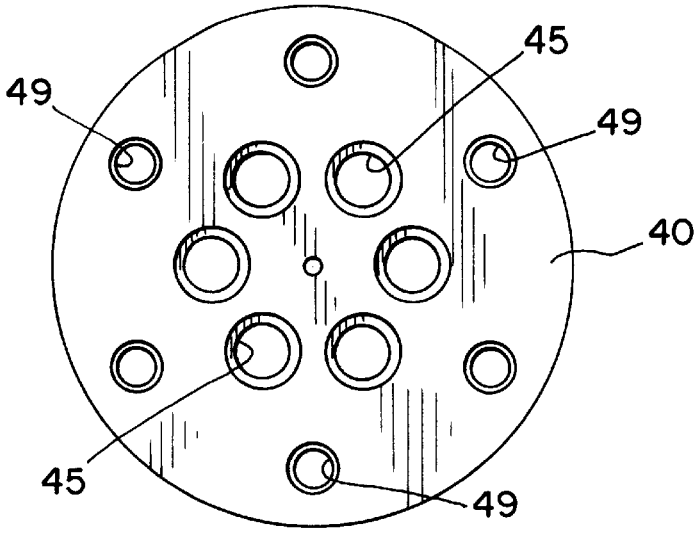
FIG. 6 is a top view of lower drive rod flange.

Referring now to FIGS. 3, 5, and 6 upper drive rod segment 30 and lower drive rod segment 32 contain upper drive rod flange 38 and lower drive rod flange 40 respectively. Flanges 38, 40 are fastened to upper and lower drive rod segments 30, 32, respectively, by a plurality of bolts 41. Bolts 41 are inserted through straight bores 45 and screwed tight into threaded bores 47.

Flange spacer 42 is disposed between upper and lower drive rod 30 and 32. Flange spacer 42 contains a plurality of apertures 43 through which a plurality of flange bolts 44 are inserted. The slide shutheight can be set by adjusting the thickness of flange spacer 42. For example, flange spacer 42 can be ground down to increase shutheight. Alternatively, flange space 42 can be replaced with a thicker flange spacer resulting in a decrease in slide shutheight.

A plurality of flanges bolts 44 are inserted through straight bored aperture 46 of upper drive rod flange 38 and tightened down into threaded aperture 49 of lower drive rod flange 40. Flange bolts 44 secure upper drive rod 30 to lower drive rod 32. Upper drive rod 30 and lower drive rod 32 may be easily separated by removing flange bolts 44 and separating upper drive rod flange 38 from lower drive rod flange 40. Although bolts are disclose and used here as fastening means to fasten upper drive rod flange 38 to lower drive rod flange 40, other appropriate fastening means may be employed to secure together flanges 38, 40.

The means for coupling the upper and lower drive rods 30, 32 together comprises upper and lower drive rod flanges 38, 40 and a plurality of bolts 41, 44. Alternatively, other suitable means for coupling together upper and lower drive rods 30, 32 may be utilized.

During the assembly of press 10, lower drive rod 32 can be assembled into press 10 separate from upper drive rod 30. Since drive rod 18 is divided into at least two drive rod segments, upper drive rod segment 30 and lower drive rod segment 32, upper drive rod housing guide 34 does not need to be perfectly in line with lower drive rod housing guide 36. In other words, upper and lower drive housing 34, 36 can be unaligned or offset with no effect to the drive. Upper and lower drive rods 30, 32 need only to be centered in their respective housing followed by flanges 38, 40 being bolted together.

Since a drive rod is split into multiple pieces and is guided by housings at multiple locations it is only important for each guide housing to be parallel to the other housing and not necessarily inline with the other housing. If the two housings guiding a single drive rod are parallel to one another then any misalignment can be accounted for as an offset between the drive rod flanges.

Figure 4:
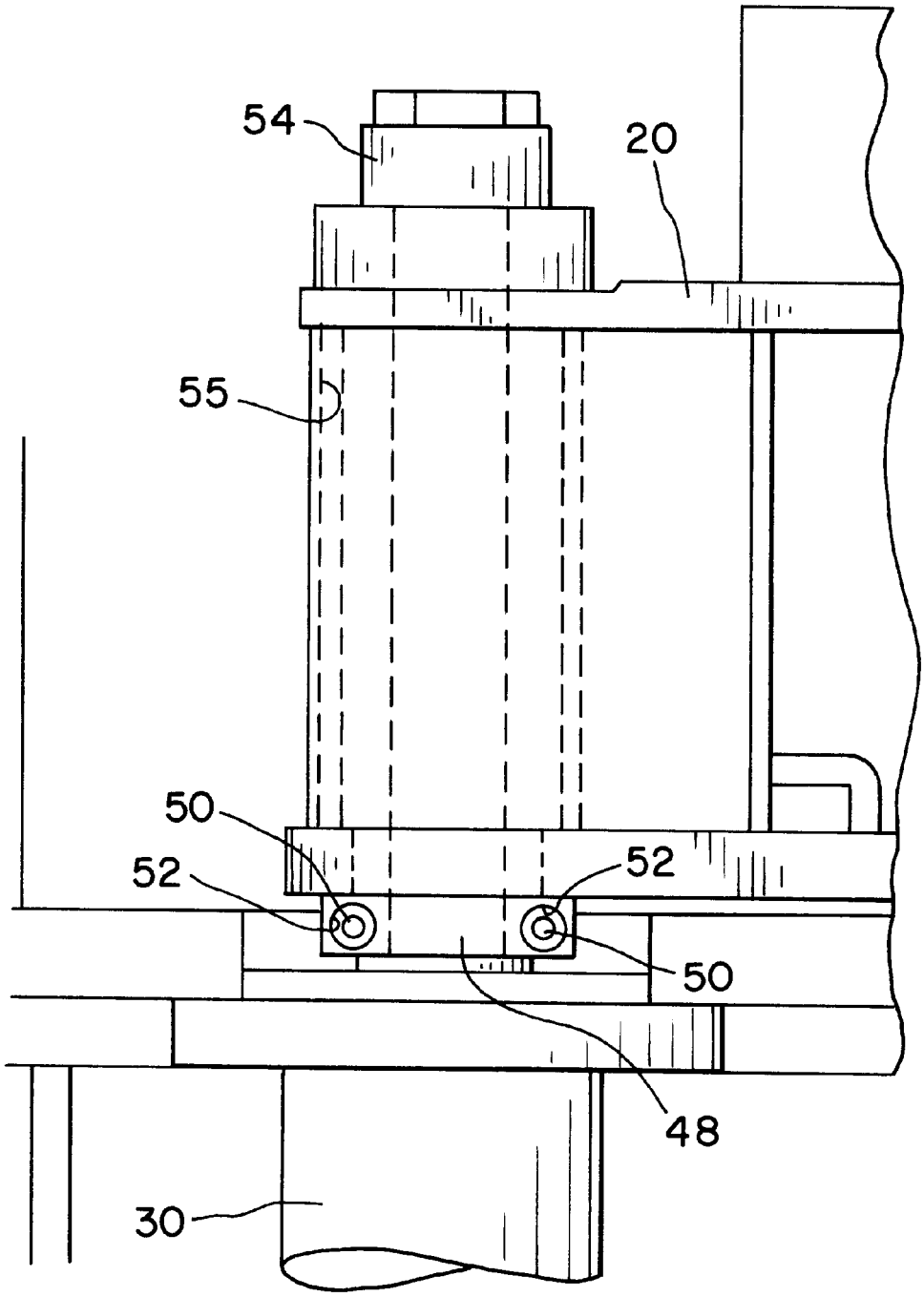
FIG. 4 shows an upper drive rod and split collar.

Referring to FIG. 4, upper drive rod 30 extends through a clearance hole or drive rod aperture 55 in upper slide 20 where clamping nut 54 is tightened down on upper drive rod 30. The diameter of the clearance hole is wider than that of upper drive rod 30. The wider clearance hole enables one to remove upper drive rod 30 from press 10 without removing slide 20. Upper drive rod 30 is removed from press 10 by first removing clamping nut 54 followed by pulled upper drive rod 30 up through drive rod aperture 55.

Split locating collar 48 is disposed annularly around upper drive rod 30 and affixed below slide 20. Split locating collar 48 sandwiches upper slide 20 between split locating collar 48 and clamping nut 54. As a result, split locating collar 48 secures upper drive rod 30 to upper slide 20.

The slide attachment means for removably attaching upper drive rod 30 to upper slide 20 comprises split locating collar 48 and clamping nut 54. Alternatively, other appropriate attachment means may be employed.

Figure 7:
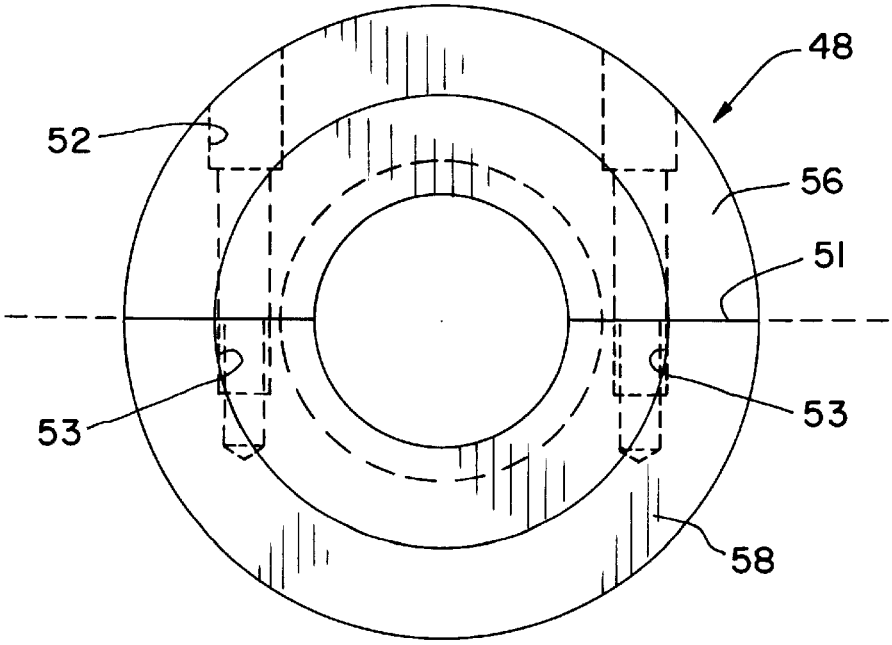
FIG. 7 is a top view of a split locating collar.

Referring now to FIG. 7 along with FIG. 4, split collar is split into two halves, 56, 58 along line 51. Bolts 50 are inserted through split collar aperture 52 and tightened down into threaded aperture 53 for clamping together split collar halves 56, 58 around upper drive rod 30. The split collar does not necessarily clamp onto drive rod. Bolts 50 simply hold the two halves together. The split collar is located on the drive rod by a shoulder.

If one wishes to remove upper drive rod 30 from press 10, upper drive rod 30 can be removed without removing upper slide 20 first. For example, it may be necessary to remove drive rod 30 from press 10 to repair or replace upper drive rod housing guide 34. In order to remove upper drive rod 30 from upper slide 20, split locating collar 48 is removed by loosening bolts 50 and removing clamping nut 54, and upper drive rod flange 38 is unclamped from lower drive rod flange 40. Upper drive rod 30 may now be pulled up through drive rod aperture 55.

Drive rod 18 can be removed from press 10 without removing upper slide 20. Drive rod 18 can be pulled up through slide 20 through drive rod aperture 55 in slide 20 since the diameter of drive rod aperture 55 is wider than the diameter of drive rod 18. Consequently, access is gained to both the upper and lower guide housing 34, 36 for replacement, removal or other service as required.

Split locating collar 48 is designed to distribute the drive rod preload across the bottom of slide 20 thus, reducing the stress created in slide 20 by the preload. The reduced stress level permits slide 20 weight to be minimized, allowing for improved bearing performance and/or faster press running speeds.

The split collar is designed to distribute the drive rod preload across the bottom of the slide to reduce the stress created in the slide by the preload. Since the split collar outside diameter is larger than the drive rod outside diameter the preload on the slide is distributed over a larger area on the bottom of the slide. Since an identical amount of preload is spread over a larger area of the slide the resultant stresses are reduced in the slide.

Press 10 is pre-assembled at a manufacture's factory. In order to ship press 10, press 10 is un-stacked. Un-stacking involves partially disassembling press 10. As shown in FIGS. 1 and 2, press 10 is un-stacked along un-stacking line 60. The present invention allows press 10 to be un-stacked without removing upper slide 20 nor completely removing drive rod 18. The un-stacking procedure may involve unclamping upper and lower drive rods 30, 32, from one another but not the removal of the entire drive rod 18 nor upper slide 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

a drive rod having two ends, said drive rod composed of at least a first and a second drive rod segments;

coupling means for joining said first drive rod segment to said second drive rod segment, each said drive rod segment having a coupling end;

a first and second flange located on said coupling end of said first drive rod segment and said second drive rod segment, respectively;

fastening means for securing together said first segment and said second segment;

a crankshaft connected to one said end of said drive rod; and a drive mechanism to rotate said crankshaft.

2. A mechanical press according to claim 1 further comprising:

a first slide; and slide attachment means for removably attaching the other said end of said drive rod to said first slide.

3. A mechanical press according to claim 2 further comprising:

a second slide, said first and second slides disposed in opposed relationship to each other; and said first slide comprising an upper slide and said second slide comprising a lower slide.

4. A mechanical press according to claim 2, wherein said coupling means further comprises said first and second flanges containing a plurality of apertures.

5. A mechanical press according to claim 4 wherein said slide attachment means comprises:

said first slide containing a drive rod aperture, the other said end of said drive rod disposed within said drive rod aperture;

a split locating collar annularly disposed along said drive rod below said slide, said split collar containing a plurality of split collar apertures; and split collar fastening means for removably clamping said split collar about said drive rod.

6. A mechanical press according to claim 5 wherein said split collar fastener means comprises a plurality of bolts disposed within said plurality of split collar apertures.

7. A mechanical press according to claim 2 wherein said slide attachment means comprises:

said first slide containing a drive rod aperture, the other said end of said drive rod disposed within said drive rod aperture;

a split locating collar annularly disposed along said drive rod below said slide said split collar containing a plurality of split collar apertures; and split collar fastening means for removably clamping said split collar about said drive rod.

8. A mechanical press according to claim 7 wherein said split collar fastener means comprises a plurality of bolts disposed within said plurality of split collar apertures.

9. A mechanical press according to claim 2 wherein a coupling means spacer is disposed between said first drive rod segment and said second drive rod segment.

10. A drive rod according to claim 1, wherein said fastening means comprises:

said first and said second flanges containing a plurality of apertures; and a plurality of bolts, said bolts inserted through said apertures of said first and said second flanges for securing together said first and second segments.

11. A mechanical press according to claim 1 wherein a drive rod segment spacer is disposed between said first drive rod segment and said second drive rod segment.

12. A mechanical press comprising:

a drive rod having two ends;

an upper slide;

slide attachment means for removably attaching said drive rod one end to said upper slide;

said slide containing a drive rod aperture, the other said end of said drive rod disposed within said drive rod aperture;

a split locating collar annularly disposed along said drive rod below said slide, said split collar containing a plurality of split collar apertures;

split collar fastening means for removably clamping said split collar about said drive rod;

a crankshaft connected to the other said end of said drive rod; and a drive mechanism to rotate said crankshaft.

13. A mechanical press according to claim 12 further comprising:

a lower slide; and said upper and said lower slides disposed in opposed relationship to each other.

14. A mechanical press according to claim 12 wherein said split collar fastener means comprises a plurality of bolts disposed within said plurality of split collar apertures.

15. A mechanical press comprising:

an upper slide and a lower slide disposed in opposed relationship to each other;

a drive rod having two ends, said drive rod composed of an upper drive rod segment and a lower drive rod segment, said upper and lower drive rod segments each containing a coupling end;

a first and second flange located on said coupling end of said first drive rod segment and said second drive rod segment, respectively, each said flange containing a plurality of flange apertures;

a drive rod segment spacer disposed between said upper and said lower drive rod segments;

a plurality of flange bolts, said flange bolts inserted through said flange apertures of said first and said second flanges for securing together said first and second drive rod segments;

said upper slide containing a drive rod aperture, an end of said drive rod disposed within said drive rod aperture;

a split locating collar annularly disposed along said drive rod below said slide, said split collar containing a plurality of split collar apertures;

split collar fastening means for removably clamping said split collar about said drive rod;

a plurality of split collar bolts disposed within said plurality of split collar apertures for removably clamping said split collar to said drive rod; and a crankshaft is connected to said other end of said drive rod.

* * * * *